US005108796A

United States Patent [19]

Yamanaka et al.

[11] Patent Number: 5,108,796

[45] Date of Patent: Apr. 28, 1992

[54] METHOD FOR FORMING JAPAN-LIKE PAINT FILM

[75] Inventors: Masahiko Yamanaka, Hadano; Hideki Nakasuji, Zama, both of Japan

[73] Assignee: Nissan Motor Co., Ltd., Yokohama, Japan

[21] Appl. No.: 534,707

[22] Filed: Jun. 8, 1990

[30] Foreign Application Priority Data

Jun. 12, 1989 [JP] Japan ..... 1-146673

[51] Int. Cl.[5] ..... B05D 3/02

[52] U.S. Cl. ..... 427/379; 427/380; 427/409; 427/388.1

[58] Field of Search ..... 427/409, 410, 379, 380, 427/388.1

[56] References Cited

U.S. PATENT DOCUMENTS

| | | | |
|---|---|---|---|
| 4,268,543 | 5/1981 | Sakakibara et al. | 427/195 |
| 4,741,932 | 5/1988 | Ichimura et al. | 427/410 |
| 4,781,949 | 11/1989 | Kasari | 427/407.1 |
| 4,933,214 | 6/1990 | Sugiura et al. | 427/379 |

FOREIGN PATENT DOCUMENTS

| | | |
|---|---|---|
| 0238037 | 9/1987 | European Pat. Off. . |
| 60-203437 | 10/1985 | Japan . |
| 63-274473 | 5/1987 | Japan . |
| 1535448 | 12/1978 | United Kingdom . |

OTHER PUBLICATIONS

*Paint Manual*, 3rd Ed. U.S. Department of the Interior Bureau of Reclamation, (1976) Stock # 024-003-001-04-0.

Treatise on Coatings: Formulations-Part I, R. R. Myers & J. S. Long-eds., vol. 4, Dekker Inc, NY., 1975.

*Primary Examiner*—Michael Lusignan

*Attorney, Agent, or Firm*—Foley & Lardner

[57] ABSTRACT

A method for forming a japan-like paint film on the surface of a steel plate forming part of an automotive vehicle outer panel. The method is comprised of coating a first coating layer of an electrodeposition paint and an intermediate coat paint, on the surface of the steel plate. Subsequently, a second coating layer is formed by coating a base coat paint and a colorless clear paint in a wet on wet manner on the first coating layer and baked to be hardened. The base coat paint contains aluminum powder in an amount of not more than 13% by weight relative to the solid content of the base coat paint. Lastly, a third coating layer is formed by coating a colored clear paint and a colorless clear paint on the second coating layer in a wet on wet manner and baked to be hardened. The colored clear paint contains particulate pigment whose content is within a range form 0.5 to 5% by weight relative to the solid content of the colored clear paint and whose particle size is within a range from 0.01 to 0.3 μm.

15 Claims, 1 Drawing Sheet

METHOD FOR FORMING JAPAN-LIKE PAINT FILM

BACKGROUND OF THE INVENTION

1. Field of the Invention

This invention relates to a method for forming a japan-like paint film having transparency and deepness feelings, on the surface of an object such as a steel plate of an automotive vehicle outer panel.

2. Description of the Prior Art

Hitherto a method for forming a japan-like paint film having transparency and deepness feelings has been proposed. In this method, an electrodeposition paint and an intermediate coat paint are coated on the surface of a steel plate and baked to be hardened. Thereafter, a base coat paint containing pigment and aluminum and a colored clear paint containing dye are coated in a wet on wet manner on the surface of the baked electrodeposition and intermediate coat paints, and are then baked thereby to form the desired paint film.

However, difficulties have been encountered in the japan-like paint film formed by such a method, in which the formed paint film deteriorates during a long time outdoor exposure so as to cause a color-change, discoloration, blistering and the like. These result from the fact that dye in the paint film has a low weatherability. Under such a deterioration, the initial transparency and deepness feelings of the paint film cannot be restored even if waxing is made on the paint film, thus degrading a commercial value of an article coated with the paint film.

SUMMARY OF THE INVENTION

It is an object of the present invention to provide an improved method for forming a japan-like paint film which can solve the problems encountered in conventional ones.

Another object of the present invention is to provide an improved method for forming a japan-like paint film which can be high in transparency and deepness feelings and high in weatherability, providing a new image and a high commercial value to an article to be coated with the paint film.

A method forming a japan-like paint film, according to the present invention comprises the following steps in the sequence set forth: a) coating an electrodeposition paint and an intermediate coat paint which are baked to form a first coating layer; b) coating a base coat paint and a colorless clear paint on the first coating layer in a wet on wet manner, the base coat paint containing aluminum powder in an amount of not more than 13% by weight relative to the solid content of the base coat paint; c) baking the coated base coat paint and colorless clear paint to form a second coating layer on the first coating layer; d) coating a colored clear paint and a colorless clear paint on the second coating layer in a wet on wet manner, the colored clear paint containing particulate pigment in an amount ranging from 0.5 to 5% by weight relative to the solid content of the colored clear paint, the particulate pigment having a particle size ranging from 0.01 to 0.3 μm; and e) baking the coated colored clear paint and colorless clear paint to form a third coating layer on the second coating layer.

BRIEF DESCRIPTION OF THE DRAWINGS

The single figure.

DETAILED DESCRIPTION OF THE INVENTION

Figure 1:
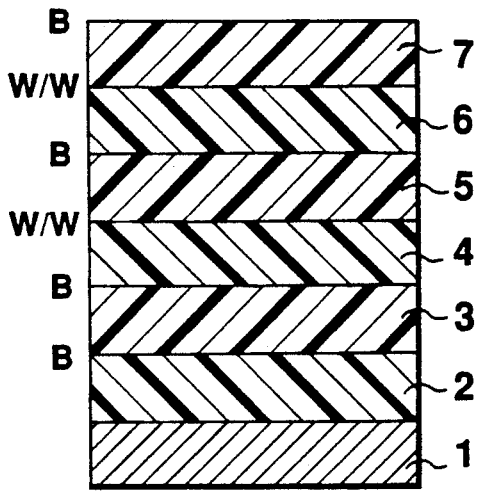
FIG. 1 is an enlarged and fragmentary sectional view of a paint film coated on an article, by a method according to the present invention.

According to the present invention, a method forming a japan-like paint film comprises the following steps in the sequence set forth: a) coating an electrodeposition paint and an intermediate coat paint which are baked to form a first coating layer; b) coating a base coat paint and a colorless clear paint on the first coating layer in a we on wet manner, the base coat paint containing aluminum powder in an amount of not more than 13% by weight relative to the solid content of the base coat paint; c) baking the coated base coat paint and colorless clear paint to form a second coating layer on the first coating layer; d) coating a colored clear paint and a colorless clear paint on the second coating layer in a wet on wet manner, the colored clear paint containing particulate pigment in an amount ranging from 0.5 to 5% by weight relative to the solid content of the colored clear paint, the particulate pigment having a particle size ranging from 0.01 to 0.3 μm; and e) baking the coated colored clear paint and colorless clear paint to form a third coating layer on the second coating layer. Meant by the term "japan" is a Japanese lacquer or "Urushi" in Japanese.

In the method according to the present invention, first the electrodeposition paint is coated on a steel plate or sheet which, for example, forms part of an automotive vehicle outer panel. Then the electrodeposition paint is baked to be hardened. An intermediate coat paint is coated on the baked electrodeposition paint and baked to be hardened. The thus formed two hardened layers constitute the first coating layer.

Subsequently, a base coat paint and a colorless clear paint are successively coated on the hardened intermediate coat paint, in a wet on wet manner in which the colorless clear paint is coated on the base coat paint is still in a wet state. Then, the thus coated base coat paint and colorless clear paint are simultaneously baked to be hardened thereby forming the second coating layer.

Next, the colored clear paint and the colorless clear paint are successively coated on the second coating layer in a wet on wet manner in which the colorless clear paint is coated on the colored clear paint which has still been in a wet state. Then, the thus coated colored clear paint and colorless clear paint are baked to be hardened thereby forming the third coating layer. Thus, each of the second and third coating layers is formed by a so-called two coatings and one baking manner.

As a result, the japan-like paint film as shown in FIG. 1 is obtained. In FIG. 1, the reference numeral 1 denotes the steel plate, 2 the electrodeposition paint, 3 the intermediate coat paint, 4 the base coat, 5 the colorless clear paint, 6 the colored clear paint, and 7 colorless clear paint. In FIG. 1, the characters B and W/W respectively designate "baking" and "coating in the wet on wet manner".

The base coat paint, the colorless clear paint and the colored clear paint are preferably formed of acrylic polyol and/or acrylic polyol modified with fluororesin and a hardener such as melamine or isocyanate.

The base coat paint contains pigment and aluminum powder. The content of the aluminum powder is not more than 13% by weight relative to the solid content of the base coat paint. The solid content of the aluminum powder is preferably not more than 8% by weight in case where the base coat paint is in a red color system including red and red-like colors or in case where the base coat paint is in a blue color system including blue and blue-like colors. It is also preferable that the content of the aluminum powder is not more than 0.5% by weight in case where the base coat paint is in black color.

The colored clear paint is colored by transparent coloring agent such as dye as usual. However, in this case, the colored clear paint contains particulate pigment in an amount 0.5 to 5%, preferably 2 to 4% by weight relative to the solid content of the paint. The particle size of the atomized pigment is within a range from 0.01 to 0.3 μm. The particle size is preferably within a range from 0.2 to 0.4 μm in case where the colored clear paint is in the red color system or in case where the colored clear paint is in the blue color system. It will be understood that the colorless clear paint has no coloring agent such as dye.

EXAMPLES

In order to evaluate the japan-like paint film of the present invention, Examples 1 to 5 will be discussed with reference to Comparative Examples 1 to 4 which are not within the scope of the present invention.

EXAMPLES 1 to 5 and COMPARATIVE EXAMPLES 1 to 3

A cold-rolled steel plate having dimensions of 70 mm×150 mm×0.8 mm was treated with zinc phosphate ("Grano-dine DP4000", the trade name of Nippon Paint Co., Ltd. in Japan). Then, an under coat paint ("Powertop U100", the trade name of Nippon Paint Co., Ltd. in Japan) was coated under electrodeposition to form a coating layer having a thickness of 20 μm. This under coat paint was baked at 175° C. for 30 minutes. Subsequently, an intermediate coat paint ("Orga S93", the trade name of Nippon Paint Co., Ltd. in Japan) was coated on the surface of the electrodeposited under coat paint by an air spray to form a coating layer having a thickness of 35 μm. This coating layer of the intermediate coat paint was baked at 140° C. for 30 minutes.

Next, a base coat paint shown in Tables 1 and 2 was coated on the coating layer of the intermediate coat paint so as to have a thickness of 15 μm. Then, a colorless clear paint was coated on the base coat paint in a wet on wet manner so as to have a thickness of 15 μm. In other words, the colorless clear paint was coated on the base coat paint which had been still wet. The thus coated base coat paint and colorless clear paint were baked at 140° C. for 30 minutes thereby to form a coating layer. Furthermore, a colored clear paint was coated on the colorless clear paint so as to have a thickness of 15 μm. Additionally, a colorless clear paint was coated on the colored clear paint in a wet on wet manner so as to have a thickness of 15 μm. The thus coated color and colorless paints were baked at 140° C. for 30 minutes to form a coating layer. As a result, each of specimens or test plates of Examples 1 to 5 and Comparative Examples 1 to 3 was prepared.

COMPARATIVE EXAMPLE 4

Formation of the coating layers of the under coat paint and the intermediate coat paint were made on the steel plate in the same manner as that in the above Examples and Comparative Examples. Then, a base coat paint as shown in Tables 1 and 2 was coated on the coating layer of the intermediate coat paint so as to have a thickness of 15 μm. Additionally, the colorless clear paint shown in Table 1 was coated on the base coat paint in a wet on wet manner so as to have a thickness of 15 μm , The thus coated base coat paint and colorless clear paint were baked at 140° C. for 30 minutes thereby to form a coating layer. Furthermore, the colorless clear paint shown in Table 1 was coated on the thus formed coating layer, and baked at 140° C. for 30 minutes. As a result, a specimen or test plate of Example 4 was prepared.

EVALUATION TEST

Evaluation tests of the below-listed items were conducted on the above specimens or test plates of the Examples and the Comparative Examples to obtain test results shown in Table 3.

(1) Adhesion of Paint film by Cross-cut test

A plurality of straight linear cuts were parallely made on the surface of the paint film with a distance of 2 mm between the adjacent lines. Then, a plurality of straight linear cuts were parallely made on the surface of the paint film in a manner to cross the former straight linear cuts thereby to form a plurality of square cut pieces. All the straight linear cuts reached the surface of the steel plate. An adhesive tape was applied on the surface of 25 square cut pieces. Then, the adhesive tape was peeled off from the surface of the paint film at a stretch, and the peeled-off condition of 25 square cut pieces of the paint film was observed to evaluate the adherance of the paint film. If all 25 square cut pieces remained not peeled off as shown as "25/25" in Table 3, the adherence of the paint film was evaluated excellent.

(2) Weatherability

A weatherability test or light radiation was carried out on each of the specimens or sample plates by using a sunshine weather-ometer (produced by Suga Test Instrument Co., Ltd. in Japan) under a test condition in which the temperature of a black (standard) panel was 63° C.; rain was used; and the test time was 750 hrs. After this test, the following items were evaluated:

a) Gloss Retention Rate (GR):

$$GR \text{ (Gloss Retention Rate) } \% = \frac{\text{Gloss after weatherability test}}{\text{Gloss before weatherability test}} \times 100$$

b) Color Difference (ΔE):

ΔE (Color Difference) was measured by a SM Color Computer produced by Suga Test Instrument Co., Ltd. in Japan. The color difference was a difference in color between the colors of the specimen before and after the weatherability test.

(3) Feelings a) Transparency feeling: The transparency feeling of each specimen was evaluated from the surface of the paint film by visual observation.

b) Deepness feeling: The deepness feeling of each specimen was evaluated from the surface of the paint film by visual observation.

TABLE 1

| | Acrylic polyol (A) | Melamine (B) | (A)/(B)[1)] |
|---|---|---|---|
| Base coat paint | Coatax LU651[2)] (trade name of Toray Co., Ltd. in Japan) | Cymel 327 (trade name of Mitsui Cynamid Co., Ltd. in Japan | 70/30 |
| Colorless clear paint | Dianal LR532[3)] (trade name of Mitsuibishi Rayon Co., Ltd. in Japan) | Cymel 327 | 70/30 |
| Colored clear paint | Dianal LR532 | Cymel 327 | 70/30 |

Note
[1)]Ratio in resin solid content
[2)]Non-volatile content . . . 50% by weight
[3)]Non-volatile content . . . 60% by weight

TABLE 2

| | | Example | | | | | Comparative Example | | | |
|---|---|---|---|---|---|---|---|---|---|---|
| | | 1 | 2 | 3 | 4 | 5 | 1 | 2 | 3 | 4 |
| Base coat paint | Content of aluminum (wt %) | 8 (0) | 8 (0) | 8 (0) | 5 | 13 | 20 | 8 (0) | 8 (0) | 10 (0.1) |
| Color clear paint | Particle size of pigment (μm) | 0.3 (0.03) | 0.3 (0.03) | 0.3 (0.03) | 0.3 (0.03) | 0.3 (0.03) | 0.3 (0.03) | 1.0 | 0.3 (0.03) | 1.0 (0.1) |
| | Concentration of pigment (wt %) | 0.5 | 3 | 5 | 3 | 3 | 0.5 | 3 | 10 | 10 |

Note: A value within ( ) represents that in case of black color.

TABLE 3

| | | Example | | | | | Comparative Example | | | |
|---|---|---|---|---|---|---|---|---|---|---|
| | | 1 | 2 | 3 | 4 | 5 | 1 | 2 | 3 | 4 |
| Adhesion | | 25/25 | 25/25 | 25/25 | 25/25 | 25/25 | 25/25 | 25/25 | 25/25 | 25/25 |
| Weatherability | GR | 80 | 85 | 90 | 87 | 85 | 70 | 80 | 85 | 75 |
| | ΔE | 1.9 | 1.8 | 1.5 | 1.8 | 2.1 | 3.5 | 2.1 | 2.2 | 3.0 |
| Transparency feeling | | good | good | good | good | good | good | bad | bad | bad |
| Deepness feeling | | good | good | good | good | good | bad | bad | bad | bad |

What is claimed is:

1. A method for forming a paint film, comprising the following steps in the sequence set forth:

(A) separately coating an electrodeposition paint and intermediate coat paint which are subsequently baked to form a first composite coating layer;

(B) separately coating a base coat paint and a colorless clear paint on the first composite coating layer in a wet on wet manner, said base coat paint containing aluminum powder in an amount of not more than 13% by weight relative to a solid content of said base coat paint and said base coat paint also containing pigment;

(C) subsequently baking the coated base coat paint and colorless clear paint to form a second composite coating layer on the first composite coating layer;

(D) separately coating a colored clear paint and a colorless clear paint on said second composite coating layer in a wet on wet manner, said colored clear paint containing particulate pigment in an amount of 0.5 to 5% by weight relative to a solid content of said colored clear paint, said particulate pigment having a particle size ranging from 0.01 to 0.3 μm; and (E) subsequently baking the coated colored clear paint and colorless clear paint to form a third composite coating layer on said second composite coating layer.

2. A method as claimed in claim 1, wherein the step of coating the electrodeposition paint and the intermediate coat paint includes coating and baking said electrodeposition paint before coating and baking said intermediate coat paint.

3. A method as claimed in claim 1, wherein the step (B) of coating said base coat paint and said colorless clear paint includes coating said base coat paint before coating said colorless clear paint.

4. As method as claimed in claim 1, wherein the step (C) of coating said colored clear paint and said colorless clear paint includes coating said colored clear paint before coating said colorless clear paint.

5. A method as claimed in claim 1, wherein said base coat, said colored clear paint and said colorless clear paint are formed of a synthetic resin selected from the group consisting of acrylic polyol and acrylic polyol modified with fluororesin.

6. A method as claimed in claim 5, wherein said synthetic resin contains a hardener selected from the group consisting of melamine and isocyanate.

7. A method as claimed in claim 1, wherein said colored clear paint contains particulate pigment in an amount ranging from 2 to 4% by weight relative to the solid content of said colored clear paint.

8. A method as claimed in claim 1, wherein said base coat paint is in a red color system, wherein said base coat paint contains aluminum powder in an amount of not more than 8% by weight relative to the solid content of said base coat paint.

9. A method as claimed in claim 1, wherein said base coat paint is in a blue color system, wherein said base coat paint contains aluminum powder in an amount of not more than 8% by weight relative to the solid content of said base coat paint.

10. A method as claimed in claim 1, wherein said base coat paint is in a black color system, wherein said base coat paint contains aluminum powder in an amount of not more than 0.5% by weight relative to the solid content of said base coat paint.

11. A method as claimed in claim 1, wherein said colored clear paint is in a red color system, wherein said colored clear paint contains particulate pigment having a particle size ranging from 0.2 to 0.4 μm.

12. A method as claimed in claim 1, wherein said colored clear paint is in a blue color system, wherein said colored clear paint contains particulate pigment having a particle size ranging from 0.2 to 0.4 μm.

13. A method for forming a paint film on a steel plate forming part of an automotive vehicle outer panel, comprising the following steps in the sequence set forth:

separately coating an electrodeposition paint and an intermediate coat paint which are subsequently baked to form a first composite coating layer on the surface of the steel plate;

coating a base coat paint on the first composite coating layer and then coating a colorless clear paint on said base coat paint while it still wet, said base coat paint containing aluminum powder in an amount of not more than 13% by weight relative to a solid content of said base coat paint and said base coat paint also containing pigment;

subsequently baking the coated base coat paint and colorless clear paint to form a second composite coating layer on the first composite coating layer;

coating a colored clear paint on said second composite coating layer and then coating a colorless clear paint on said colored clear paint while it is still wet, said colored clear paint containing particulate pigment in an amount of 0.5 to 5% by weight relative to a solid content of said colored clear paint, said particulate pigment having a particle size ranging from 0.01 to 0.3 μm; and subsequently baking the coated colored clear paint and colorless clear paint to form a third composite coating layer on said second composite coating layer.

14. A method for forming a paint film, comprising the following steps in the sequence set forth;

coating and baking an electrodeposition paint and then coating and baking an intermediate coat paint to form a first composite coating layer;

coating a base coat paint on the first composite coating layer and then coating a colorless clear paint on said base coat paint while it still wet, said base coat paint containing aluminum powder in an amount of not more than 13% by weight relative to a solid content of said base coat paint and said base coat paint also containing pigment;

subsequently baking the coated base coat paint and colorless clear paint to form a second composite coating layer on the first composite coating layer;

coating a colored clear paint on said second composite coating layer and then coating a colorless clear paint on said colored clear paint while it is still wet, said colored clear paint containing particulate pigment in an amount of 0.5 to 5% by weight relative to a solid content of said colored clear paint, said particulate pigment having a particle size ranging from 0.01 to 0.3 μm; and subsequently baking the coated colored clear paint and colorless clear paint to form a third composite coating layer on said second composite coating layer.

15. A method for forming a japan-like paint film on a steel plate forming part of an automotive vehicle outer panel, comprising the following steps in the sequence set forth:

coating and baking an electrodeposition paint and then coating and baking an intermediate coat paint to form a first composite coating layer on the surface of the steel plate;

coating a base coat paint on the first composite coating layer and then coating a colorless clear paint on said base coat paint while it still wet, said base coat paint containing aluminum powder in an amount of not more than 13% by weight relative to a solid content of said base coat paint and said base coat paint also containing pigment;

subsequently baking the coated base coat paint and colorless clear paint to form a second composite coating layer on the first composite coating layer;

coating a colored clear paint on said second composite coating layer and then coating a colorless clear paint on said colored clear paint while it is still wet, said colored clear paint containing particulate pigment in an amount of 0.5 to 5% by weight relative to a solid content of said colored clear paint, said particulate pigment having a particle size ranging from 0.01 to 0.3 μm; and subsequently baking the coated colored clear paint and colorless clear paint to form a third composite coating layer on said second composite coating layer.

* * * * *